United States Patent [19]

Hahn

[11] 4,056,030

[45] Nov. 1, 1977

[54] COMBINED MITER BOX, CORNER CLAMP AND MEASURING GAUGE

[75] Inventor: Roy C. Hahn, Bensenville, Ill.

[73] Assignee: Hahn Manufacturing Co., Franklin Park, Ill.

[21] Appl. No.: 735,427

[22] Filed: Oct. 26, 1976

[51] Int. Cl.[2] ..... B27B 21/08

[52] U.S. Cl. ..... 83/762; 83/522; 83/581

[58] Field of Search ..... 83/761, 762, 763, 765, 83/764, 522, 581; 269/1, 295

[56] References Cited

U.S. PATENT DOCUMENTS

| | | | |
|---|---|---|---|
| 565,652 | 8/1896 | Walter et al. | 83/765 |
| 976,097 | 11/1910 | Peterson | 83/763 |
| 2,908,300 | 10/1959 | Hahn | 83/763 |

*Primary Examiner*—Donald R. Schran

*Attorney, Agent, or Firm*—Arnstein, Gluck, Weitzenfeld & Minow

[57] ABSTRACT

A combined miter box, corner clamp and measuring gauge apparatus is provided. The apparatus is particularly suitable for use in forming picture frames, frames for screens, or trims for other purposes and very precise and accurate cuts may be obtained due to the location and placement of an adjustable saw guide and because of the inclusion of a measuring gauge.

6 Claims, 14 Drawing Figures

COMBINED MITER BOX, CORNER CLAMP AND MEASURING GAUGE

BACKGROUND OF THE INVENTION

The present invention relates to a combined miter box, corner clamp and measuring gauge apparatus for receiving and retaining frame members to be cut at a right or left 45° angle, and when adjoining mitered frame sections have been cut and made ready for joining their mitered ends, these sections are retained securely for ready attachment at a 90° angle. Such frame members are particularly suitable for use is forming picture frames, frames for screens or trim for other purposes. It is a feature of this invention that very precise cuts in such frames or trim can be made because of the placement of the saw guide means of this invention, and because of the inclusion of removable measuring gauge means that are provided which may be connected to the combined miter box and corner clamp so that precise cuts in different pieces of frame or trim can be made and duplicated, particularly by a do-it-yourselfer.

It is noted that prior art combined miter boxes and corner clamps such as is disclosed in my U.S. Pat. No. 2,908,300, issued Oct. 13, 1959, lack the measuring gauge saw guide features of the present invention.

SUMMARY OF THE INVENTION

Therefore, it is an objection of the present invention to provide a combined miter box, corner clamp and measuring gauge apparatus which is capable of being utilized with a wide variety of material to be cut, particularly frames and trim.

It is another object of this invention to provide a combined miter box, corner clamp and measuring gauge apparatus for cutting a clamped frame section or trim at a right or left 45° angle while such section is securely held, and then securely and accurately retaining the mitered and abutting ends of adjoining sections at a 90° angle while they are joined together.

It is a specific object of this invention to provide a combined miter box, corner clamp and measuring gauge apparatus with an adjustable saw guide means so that at least a portion of said means is positioned directly over a frame member to be cut in the apparatus.

It is still a further specific obect of this invention to provide measuring gauge means to a combined miter box and corner clamp.

Therefore, the present invention provides a combined miter box, corner clamp and measuring gauge apparatus comprising, in combination: (a) a support having projections spaced apart at an angle of 90°, said projections each being provided with a threaded lug; (b) an adjusting screw threaded into each lug; (c) a clamping jaw on each adjusting screw; (d) a handle on the outer end of the adjusting screw for adjusting the screw and clamping jaw; (e) a shoulder on said support at the inner end of each of said projections with said shoulders disposed relative to each other at an angle of 90° and disposed opposite to its clamping jaw with the adjacent ends of said shoulders spaced apart; (f) a ledge on and extending adjacent to and along the rear of each of said shoulders, said ledge having a longitudinal channel bisecting said shoulders and said ledge, and a saw guide mounting post means carried on a portion of said ledge adjacent one side of said channel; (g) an adjustable saw guide means mounted on said post means; and, (h) a measuring gauge means removably connected to said support and capable of receiving a frame member to be precisely cut in said apparatus.

The invention can be most clearly described and illustrated with reference to the attached drawings which are representations of specific embodiments of my invention.

BRIEF DESCRIPTION OF THE DRAWINGS

Referring now to the drawings forming a part of this specification and illustrating preferred embodiments of my invention.

BRIEF DESCRIPTION OF A PREFERRED EMBODIMENT

Figure 2:
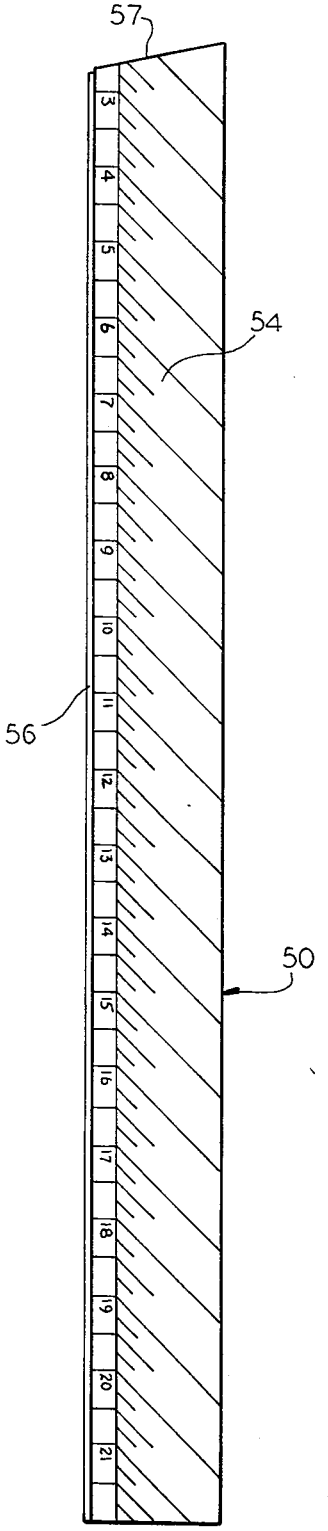
FIG. 2 is a top plan view of the measuring gauge means of this invention.
Figure 1:
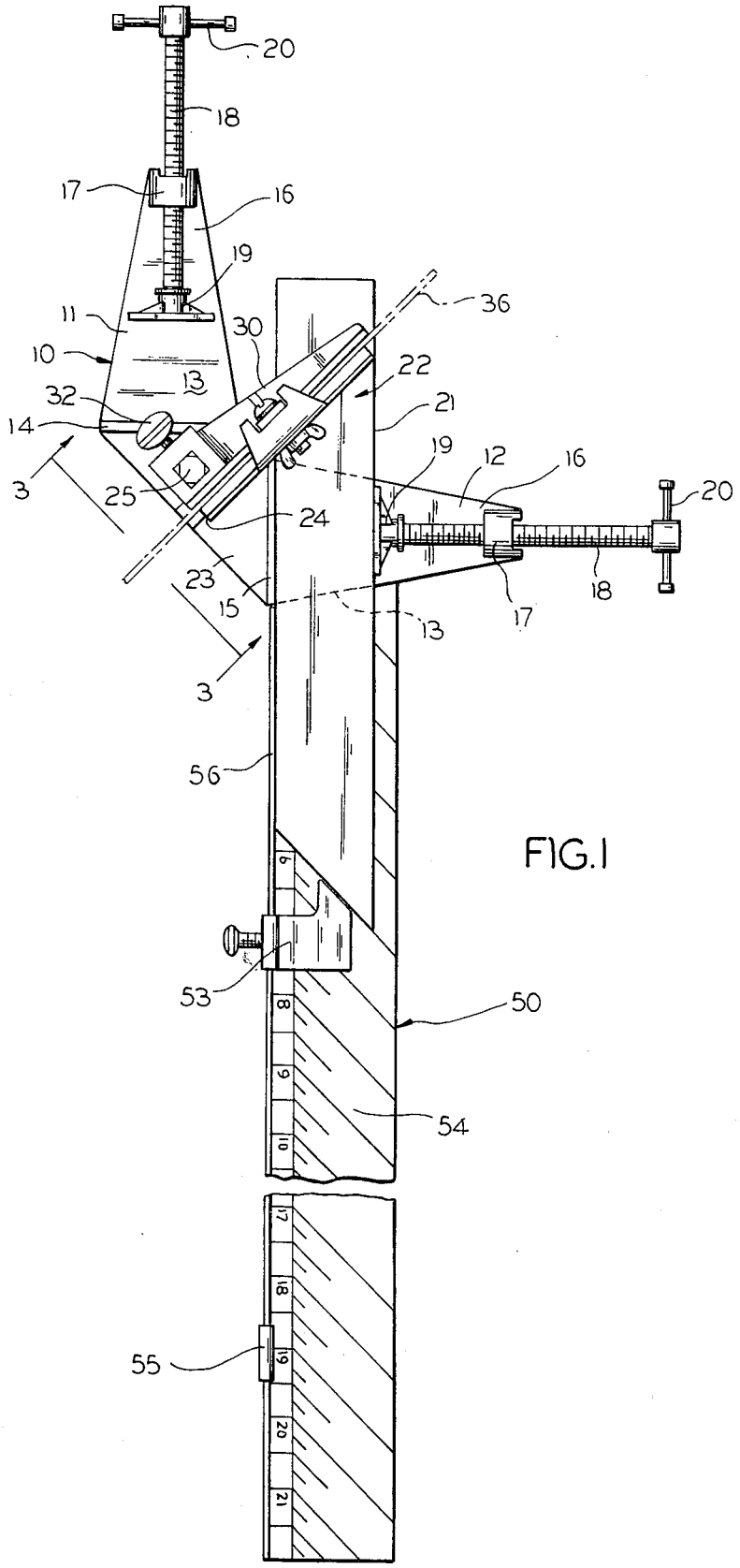
FIG. 1 is a top plan view showing the combined miter box, corner clamp and measuring gauge apparatus of this invention.

Referring now generally to the drawings, the present combined miter box, corner clamp and measuring gauge apparatus comprises a rigid support or frame 10 of metal or other material suitable for the purpose and provided with spaced arms or projections 11 and 12 disposed at an angle of 90° to each other, with each projection of substantially triangular shape with a relatively wide and flat base 13 merging into spaced and angularly arranged uprights or shoulders 14 and 15 projecting vertically above the flat upper surface of the support 10 and each projection narrowing at its outer end to a relatively narrow ledge 16 provided adjacent its outer end with an upwardly projecting and internally threaded lug 17 for receiving a threaded adjusting screw 18.

Each adjusting screw 18 is provided at its inner clamping end with a wide clamping jaw 19 freely swiveled on the inner end of the screw 18, the outer end of which screw 18 beyond the lug 17 having a transverse pin 20 projecting therethrough and forming a handle for rotating the screw and longitudinally moving its clamping jaw 19. Each clamping jaw is adapted to be moved into engagement with the adjacent longitudinal edge 21 of a frame section or a length of trim 22 whereby the section 22 may be securely held between a clamping jaw 19 and a shoulder 14 or 15 on the support, and may be cut to provide a mitered end (not shown) while so retained. When adjoining frame sections are to be joined, the mitered or abutting ends thereof are brought into a continuous surface contact and locked in that position by the clamping jaws of the apparatus, after which the complementary ends may be accurately and securely joined together with the frame sections disposed at an angle of 90°.

Figure 3:
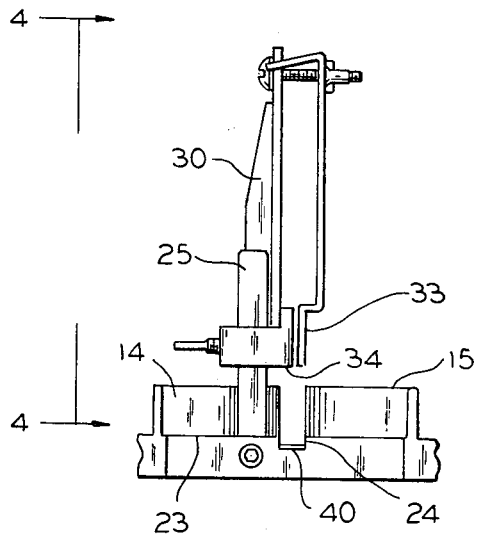
FIG. 3 is a view in front elevation taken along the line 3—3 of FIG. 1 and viewed in the direction of the arrows.
Figure 4:
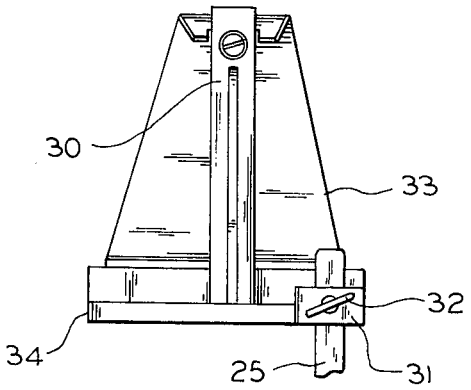
FIG. 4 is a view taken along the line 4—4 of FIG. 3 and viewed in the direction of the arrows.
Figure 5:
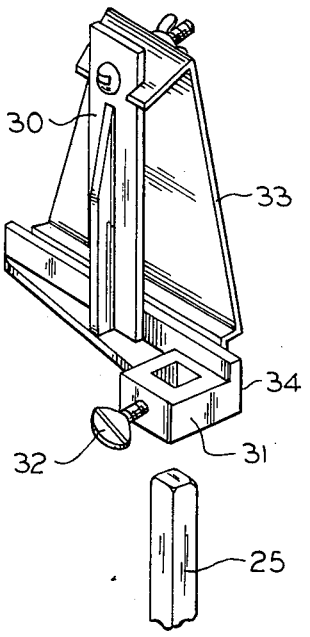
FIG. 5 is a perspective view of a saw guide means.
Figure 6:
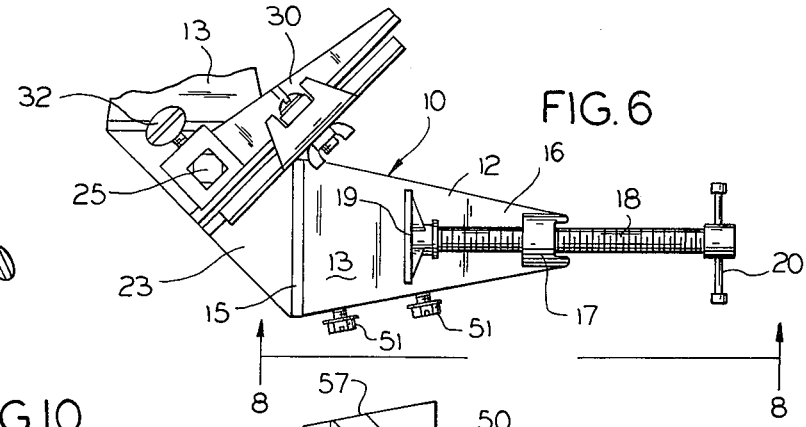
FIGS. 6 and 7 are fragmentary top plan views of the apparatus and the measuring gauge.
Figure 10:
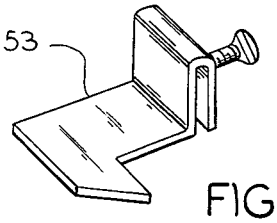
FIG. 10 is a perspective view of the positioning means of said measuring gauge means.
Figure 7:
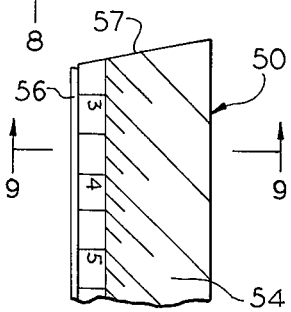
Figure 11:
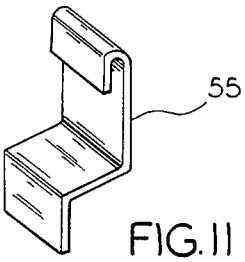
FIG. 11 is a perspective view of the slidable level support means of the measuring gauge means.
Figure 8:
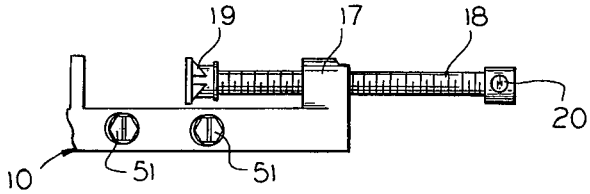
FIG. 8 is a fragmentary section of FIG. 6 taken along the line 8—8 of FIG. 6, and viewed in the direction of the arrows.
Figure 12:
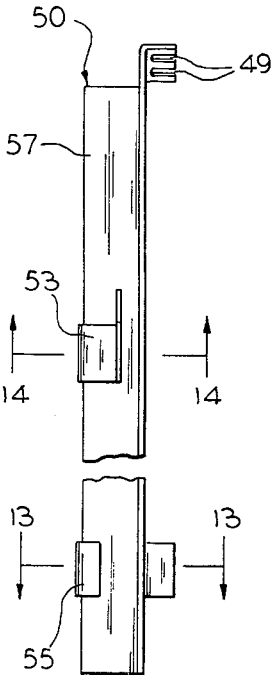
FIG. 12 is a side view of said measuring gauge means with said positioning means and level support means shown.
Figure 9:
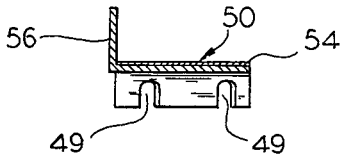
FIG. 9 is a cross-sectional view of FIG. 7 taken along the line 9—9 of FIG. 7.
Figure 13:
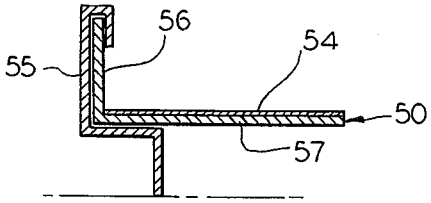
FIG. 13 is a cross-sectional view of FIG. 12 taken along the line 13—13 of FIG. 12 and rotated 90°; and, FIG. 14 is a cross-sectional view taken substantially along the line 14—14 of FIG. 12 and rotated 90°.
Figure 14:
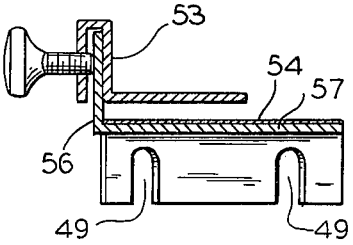

The support 10, at the rear of each shoulder 14 and 15 is provided with a ledge 23 on and extending adjacent to and along the rear of each of said shoulders 14 and 15, said ledge having a longitudinal channel 24 bisecting said shoulders and said ledge, and a saw guide mounting post means 25 carried on a portion of said ledge 23 adjacent one side of channel 24, as is shown in the drawings, or the post means may be fastened to or formed as an integral part of the saw guide itself. In FIG. 3, an adjustable saw guide means 30 is shown slidably mounted on said post means 25. However, ledge 23 may have adjustable means (not shown) to adjustably receive post means fastened or formed as an integral part of the saw guide and the post means should slidably be raised or lowered through said ledge.

It is a feature of this invention that at least a portion of the saw guide means utilized be positioned directly over said frame section 22 to be cut in this apparatus so as to be able to guide the saw directly over the piece or section to be cut. The saw guide means may include a saw guide mounting post receiver means 31 for receiving said mounting post 25, saw guide mounting post fastening means 32 for co-acting with said post receiver means 31 and said mounting post 25, and a pair of adjustable saw guides 34 adjustably spaced apart for receiving a saw blade 36 therebetween. In addition, it is contemplated that the saw guide mounting post receiver means 31 and saw guide mounting post fastening means 32 could be carried on ledge 23, with post means 25 being attached to saw guide means 30 by means of a rivet, screw or the like. However, regardless of the construction of the saw guide, and mounting post means, it is particularly preferred that at least a portion of the saw guide means be such that it can be positioned directly over the material to be cut in this invention. In connection therewith, as shown in FIG. 3, a strip of resilient material 40 may be disposed in channel 24 to provide an abutment against which the cutting edge of the saw may make contact when the mitered ends of a frame are being formed.

A measuring gauge means 50 is provided and may be removably connected to said support 10 by co-operating fastening means 49 (which may be slots or channels or the like formed in means 50) and 51 (which may be threaded connectors or screws, or the like) and said gauge means is of sufficient width as to be capable of receiving a frame section 22 to be precisely measured and cut in said apparatus. The measuring gauge means may include positioning means 53, measuring means 54 and slidable level support means 55. It is a particularly preferred embodiment of this invention in that the measuring gauge means 50 is a generally L-shaped member with at least one leg 56 in linear alignment with one of said shoulders 14 or 15 of said apparatus and the remaining leg 57 of said member is coplanar with one of said projections 11 or 12.

In another preferred embodiment of my invention, positioning means 53 will be so formed as to be able to rest and slide upon leg 56 of measuring gauge means 50 and will be able to be fixed at a predetermined position by means of, for example, a thumb screw which will physically be screwed through the positioning means until the end of the thumb screw frictionally engages leg 56. The measuring means 54 may be constructed by inscribing or printing measurements, in inches, or in metric measurements, directly on leg 57 of said measuring gauge, or the measuring means may be printed on pressure sensitive tapes, and the like, and attached to leg 57 by means of pressure sensitive adhesives, glues, or other attaching means. The slidable level support means 55 may also be formed in a generally L-shaped configuration to match the generally L-shaped measuring gauge means member 50. However, the slidable level support means 55 will have a leg depending from the generally L-shaped configuration to rest upon a support or table, or the like, and the top portion of said level support means will be provided with a generally U-shaped configuration to slidably rest upon leg 56 of said means 50. In this manner, the slidable level support means can be pushed back and forth so that it is out of the way and yet provide a substantially level measuring and working surface.

By using this apparatus, a do-it-yourselfer can place a section of frame or trim on the measuring gauge at a predetermined position, cut his first 45° angle, and then place a second frame or trim section in the device and duplicate, exactly, the first section. If all four sides of, for example, a frame are of equal length, an additional two sections can be cut, all of exact dimension, and the remaining 45° angles can be very quickly and accurately cut. If, for example, the frame of the previous example is such that two of the sides are longer or shorter than the first two sides cut, the positioning means can be moved to the new dimension and exact lengths of frame can be cut and mitered so that a very professional result is obtained.

After the 45° angles have been cut, the pieces of frame to be attached to each other can be very readily attached in the combined miter box, corner clamp and measuring gauge apparatus of this invention and securely fastened to each other by means of glue, nails, brads and the like.

It is also contemplated in the scope of this invention that attaching means, such as screws, bolts or the like may be used to anchor the apparatus of this invention to a workbench or other supporting surface, if the user so desires.

PREFERRED EMBODIMENT

In a particularly preferred embodiment of my invention, this invention provides a combined miter box, corner clamp and measuring gauge apparatus comprising, in combination: a support having projections spaced apart at an angle of 90°, said projections each being provided with a threaded lug; an adjusting screw threaded into each lug; a clamping jaw on each adjusting screw; a handle on the outer end of the adjusting screw for adjusting the screw and clamping jaw; a shoulder on said support at the inner end of each of said projections with said shoulders disposed relative to each other at an angle of 90° and disposed opposite to its clamping jaw with the adjacent ends of said shoulders spaced apart; a ledge on and extending adjacent to and along the rear of each of said shoulders, said ledge having a longitudinal channel bisecting said shoulders and said ledge, and a saw guide mounting post means carried on a portion of said ledge adjacent one side of said channel; an adjustable saw guide means mounted on said post means so that at least a portion of said saw guide means is positioned directly over a frame member to be cut in said apparatus, the saw guide means including saw guide mounting post receiver means for receiving said mounting post, saw guide mounting post fastening means for co-acting with said post receiver means and said mounting post, and a pair of adjustable saw guides spaced apart for receiving a saw blade therebetween; and, a measuring gauge means, including positioning means, measuring means and slidable level support means, said measuring gauge means removably connected to said support and capable of receiving a frame member to be precisely cut in said apparatus, said measuring gauge means being a generally L-shaped member with at least one leg of said member in linear alignment with one of said shoulders of said apparatus and the remaining leg of said member being coplanar with one of said projections.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. A combined miter box, corner clamp and measuring gauge device for producing rectangular frames from trim strips, comprising a. an integral support having two outwardly extending arms diverging perpendicularly from each other and an integral supporting ledge extending therebetween, b. straight vertically upstanding shoulders at the junctions of the inner ends of said arms and ledge, said shoulders extending in planes perpendicular to each other with a gap at their adjacent ends for accommodating a cutting saw blade therebetween, c. internally threaded lugs at the outer ends of said arms, each provided with a threaded adjusting screw with operating means therefor at the outer end and a clamping jaw at the inner end for cooperative action with a respective shoulder to clamp a trim strip therebetween, d. said integral ledge having a channel in the top thereof along a line bisecting the right angle between the longitudinal axes of said arms and below said gap for allowing movement of said cutting saw blade below the upper surfaces of said arms incidental to the angular cutting of the trim strips adapted to rest on said arms, e. a unitary saw guide assembly and support means therefor on said ledge at one side of said channel for detachably setting the cutting saw blade in overlying relation to said channel and gap, and f. a rectilinear measuring gauge detachably connected to an outer edge of one of said arms for measuring the length of the trim strip from the vertical plane containing said bisecting line.

2. An apparatus as set forth in claim 1, wherein said measuring gauge comprises a horizontal supporting and measuring surface at the same level as the supporting surface of the arm to which it is detachably connected, and an upwardly directed flange along one edge of said surface in the same vertical plane as the vertical shoulder on said arm.

3. An apparatus as set forth in claim 2, wherein the supporting and measuring surface of said gauge bears parallel graduating marking lines extending in planes normal to that of said bisecting line, and an adjustable gauge slidably movable on said flange having a limit stop in a horizontal plane for measuring and fixing the distance from the mitered end-cut of a trim strip to said plane of said bisecting line.

4. An apparatus as set forth in claim 2, wherein said measuring gauge includes means extending below said horizontal supporting and measuring surface for supporting said gauge on the same working surface as that bearing said integral support so that the supporting surface of said arm and measuring surface of the gauge are maintained at said same level.

5. An apparatus as set forth in claim 1, wherein the support means for the saw guide assembly comprises adjustable means for varying the height thereof relative to the supporting surface of said arms.

6. An apparatus as set forth in claim 5, wherein said support means comprises a post mounted vertically on said ledge, said saw guide assembly having a socket on one side thereof slideable on said post, and means for fixing said socket on said post at an adjustable level.

* * * * *